United States Patent [19]

Schiff et al.

[11] 4,197,682

[45] Apr. 15, 1980

[54] SKYLIGHT ESCAPE SYSTEM

[76] Inventors: Ernest Schiff, 10214 Jeanes St., Philadelphia, Pa. 19116; Gerard J. Carmen, 3121 Derry Rd., Philadelphia, Pa. 19154

[21] Appl. No.: 926,756

[22] Filed: Jul. 21, 1978

[51] Int. Cl.[2] ..... E04B 7/16

[52] U.S. Cl. ..... 52/72; 52/200; 49/404; 98/42 R

[58] Field of Search ..... 52/72, 200, 66, 64; 49/221, 404, 37, 70; 98/42

[56] References Cited

U.S. PATENT DOCUMENTS

| | | | |
|---|---|---|---|
| 2,120,060 | 6/1938 | Williams | 52/72 X |
| 3,277,619 | 10/1966 | Miller et al. | 52/72 |
| 3,350,819 | 11/1967 | Polidoro et al. | 52/72 X |
| 3,815,299 | 6/1974 | Sorensen et al. | 52/66 |
| 3,903,661 | 9/1975 | Gobel | 52/72 |

FOREIGN PATENT DOCUMENTS

| | | | |
|---|---|---|---|
| 773087 | 8/1934 | France | 52/72 |

*Primary Examiner*—J. Karl Bell

*Attorney, Agent, or Firm*—Weiser, Stapler & Spivak

[57] ABSTRACT

The Skylight Escape System of the present invention includes a roof curb which defines an escape opening to the roof therewithin. A pair of spaced guides project upwardly from opposite sides of the curb and a pair of spaced tracks are provided immediately adjacent thereto. A movable skylight which upwardly carries a translucent panel is formed with cooperating slides, which slides are in sliding engagement within the spaced tracks. The application of longitudinally directed forces to portions of the skylight causes the skylight to move along the tracks relative to the curb to expose the opening for building escape purposes.

7 Claims, 4 Drawing Figures

SKYLIGHT ESCAPE SYSTEM

BACKGROUND OF THE INVENTION

The invention relates generally to the field of skylight type structures, and more particularly, is directed to a combination skylight, ventilator and escape hatch which can be installed on both new and existing buildings.

It is common practice in the construction industry, especially in large, metropolitan, built-up areas to construct dwellings in side-by-side arrangement both in the interest of saving construction costs and also to conserve valuable land area. Such dwellings are commonly referred to as "town houses" or "row houses".

In designing and constructing such town houses, it is usual to build such dwellings two stories in height to accommodate a single family. Also, it is most usual to provide but a single stairway for the inhabitants to travel between the first and second story. Due to the low density or ratio of persons per dwelling, the single stairway complies with existing building and safety codes and usually offers adequate protection for the inhabitants.

Because of the side-by-side nature of the construction, exterior window space is at a premium and accordingly, any windows available at the front of a house or at the rear of a house or at any side court are usually designed for use with rooms intended for living purposes, such as bedrooms. Accordingly, most frequently, there is no outside window available for the bathroom, even though most building codes and housing codes as well as good construction practice dictates that such bathrooms be provided with direct outside access for ventilation purposes. In such situations, where the bath is designed as an interior room without access to an exterior wall, a skylight of suitable dimensions is usually provided to provide the necessary light and ventilation as well as to comply with applicable code requirements.

Because of the usual provision for only a single stairway, even though the single stairway usually offers adequate safety and egress for all situations except extreme emergencies, experience has shown that such town house or row house designs could somtimes offer a serious life safety hazard to occupants of the second floor in the case of fire or other emergency. It is with this thought in mind that the present combination skylight, ventilator and escape hatch has been designed to thereby provide an emergency escape route through the roof.

Prior workers in the art have developed skylight systems which are capable of opening in relatively easy manner to provide direct access thereto. U.S. Pat. Nos. 3,520,245, 3,557,497 and 3,996,844 are exemplary of prior art skylight constructions which include means to readily open the skylight when desired.

SUMMARY OF THE INVENTION

The present invention relates generally to skylight constructions, and more particularly, is directed to a skylight escape system including a permanently installed track and a movable skylight member including a translucent panel which is slidable along the track.

The skylight escape system of the present invention comprises generally a fixed curb which upwardly extends from the roof construction and defines an opening communicating with the living space within the building below. The curb is preferably rectangular in configuration and is suitably flashed in known manner to prevent water leakage thereabout. Opposed members of the curb are equipped with a spaced pair of transversely extending tracks which are suitably configured to permit easy, sliding engagement of a movable skylight member.

The movable skylight member upwardly carries a translucent panel in position to admit light into the building through the opening defined within the curb. The movable member may also be equipped with a manually openable ventilator if so desired to also permit room ventilation through the opening defined by the curb.

The movable member is downwardly provided with a pair of spaced, cooperating slides which are configured to the engage upon and slide relative to spaced tracks mounted on the curb whereby the entire movable member can be easily urged transversely along the tracks upon the application of manual, transversely directed forces upon the movable member. Preferably, the movable member includes peripheral, downwardly extending skirts which overlie the curb and the curb flashing to further aid in weatherproofing the installation.

It is also desirable to provide interior, quick acting locking devices to detachably secure the movable member to the curb in the closed and locked position to thereby prevent unauthorized entry into the building interior from the roof through the skylight. By making the locks quickly detachable, no time will be lost in sliding the movable member along the tracks in case of emergency. Also, in view of the fact that it is contemplated that the skylight escape system will be installed in the ceiling of the second story, or in some cases the third story if used, it is also desirable to provide some type of ladder mechanism to facilitate access to the skylight escape system.

It is therefore an object of the present invention to provide an improved skylight escape system of the type set forth.

It is another object of the present invention to provide a novel skylight escape system comprising a fixed curb, a fixed track secured to the curb and a movable member slidable along the track to allow escape through an opening defined within the curb.

It is another object of the present invention to provide a novel skylight escape system comprising a roof curb defining an opening therewithin, a pair of spaced, transverse tracks secured to opposed members of the curb, a movable skylight member including bottom positioned slides which cooperate with the tracks whereby the movable member is readily moved relative to the curb to allow building escape through the curb opening.

It is another object of the present invention to provide a novel skylight escape system including an opening in the building roof, a curb surrounding the opening, a movable skylight member positioned upon the curb and slide means interposed between the curb and the movable skylight member to allow the movable member to be traversed upon the application of external forces.

It is another object of the present invention to provide a novel skylight escape system including a permanently installed roof curb, an opening defined within the curb, and a movable member in transverse, sliding engagement upon the curb, said movable member including translucent means to permit light to enter the building through the roof opening and ventilation means to permit ventilation into the building through the roof opening.

It is another object of the present invention to provide a novel skylight escape system that is rugged in construction, simple in design and trouble-free when in use.

Other objects and a fuller understanding of the invention will be had be referring to the following description and claims of a preferred embodiment thereof, taken in conjunction with the accompanying drawings wherein like reference characters refer to similar parts throughout the several views, and in which:

DESCRIPTION OF THE PREFERRED EMBODIMENTS OF THE INVENTION

Figure 1:
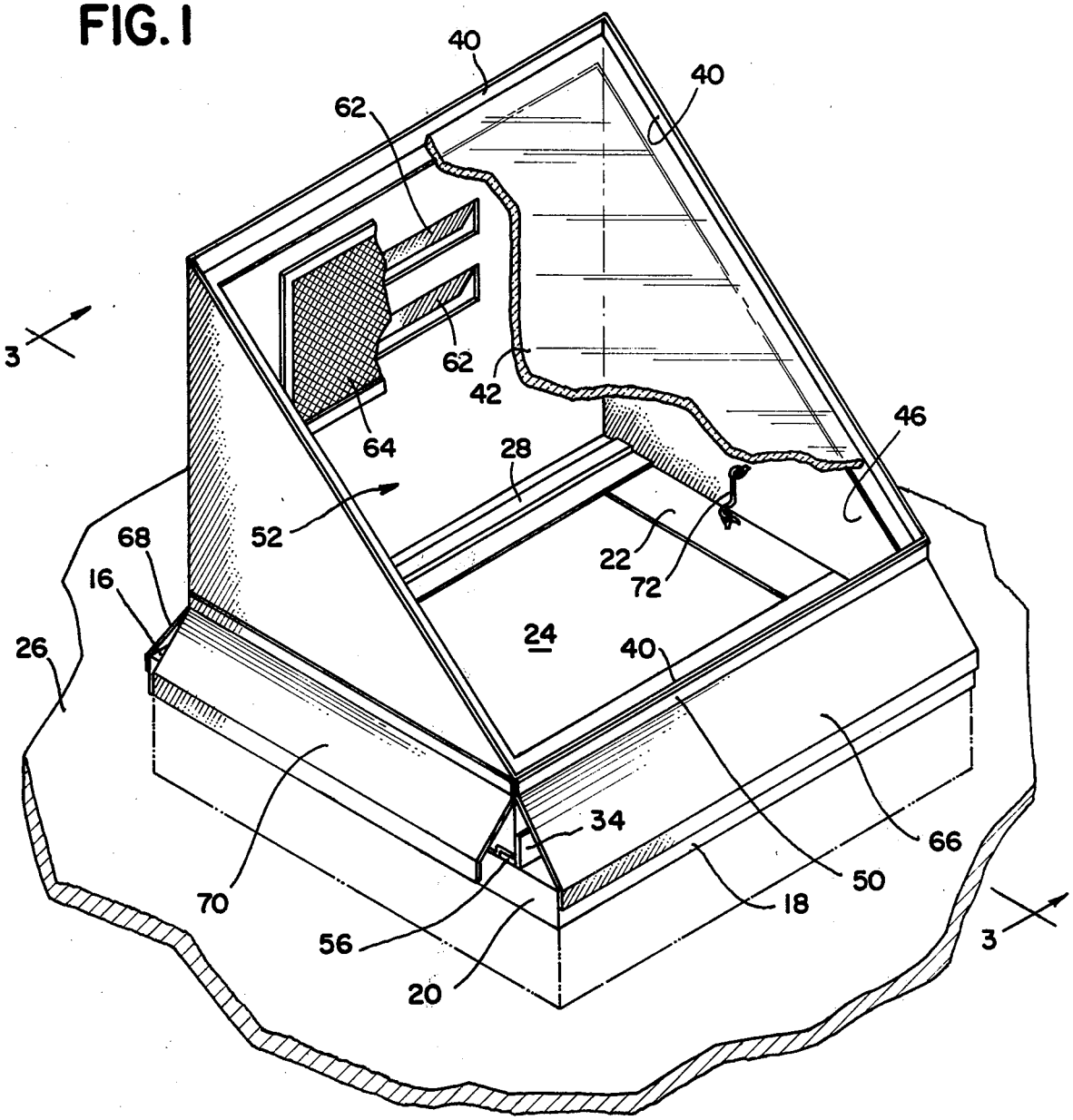
FIG. 1 is a perspective view of the skylight escape system of the present invention, parts of which have been partially broken away to disclose details of interior construction.

Although specific terms are used in the following description for the sake of clarity, these terms are intended to refer only to the particular structure of the invention selected for illustration in the drawings, and are not intended to define or limit the scope of the invention.

Figure 2:
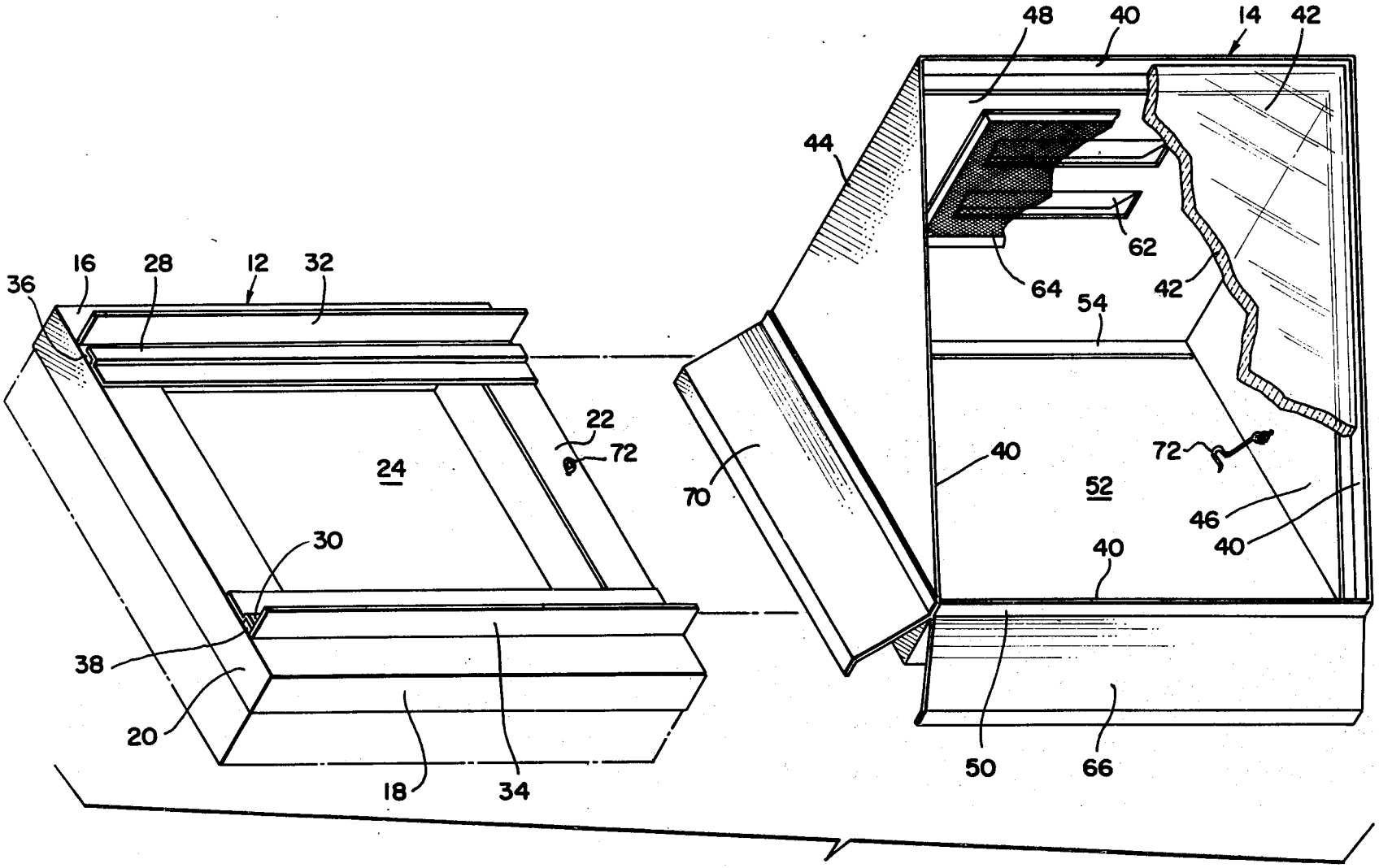
FIG. 2 is an exploded perspective view of the skylight escape system of FIG. 1.

Referring now to the drawings, there is illustrated in FIGS. 1 and 2 a skylight escape system which comprises a fixed curb means 12 and a movable skylight means 14. The curb means 12 comprises generally a pair of spaced, opposed, transverse frame members 16, 18 and a pair of spaced, longitudinal frame members 20, 22 which extend at right angles thereto to define a rectangular opening 24 therewithin. As best seen in FIG. 1, the curb means 12 extends above the level of the roof 26 and the opening 24 is open completely through the roof in communication with the living area of the floor immediately below (not illustrated). The transverse and longitudinal frame members 16, 18, 20, 22 project upwardly from the surface of the roof 26 and should be suitably flashed in well-known manner to prevent the entrance of rainwater, snow, sleet, etc. through the junction between the curb means 12 and the roof 26.

Figure 3:
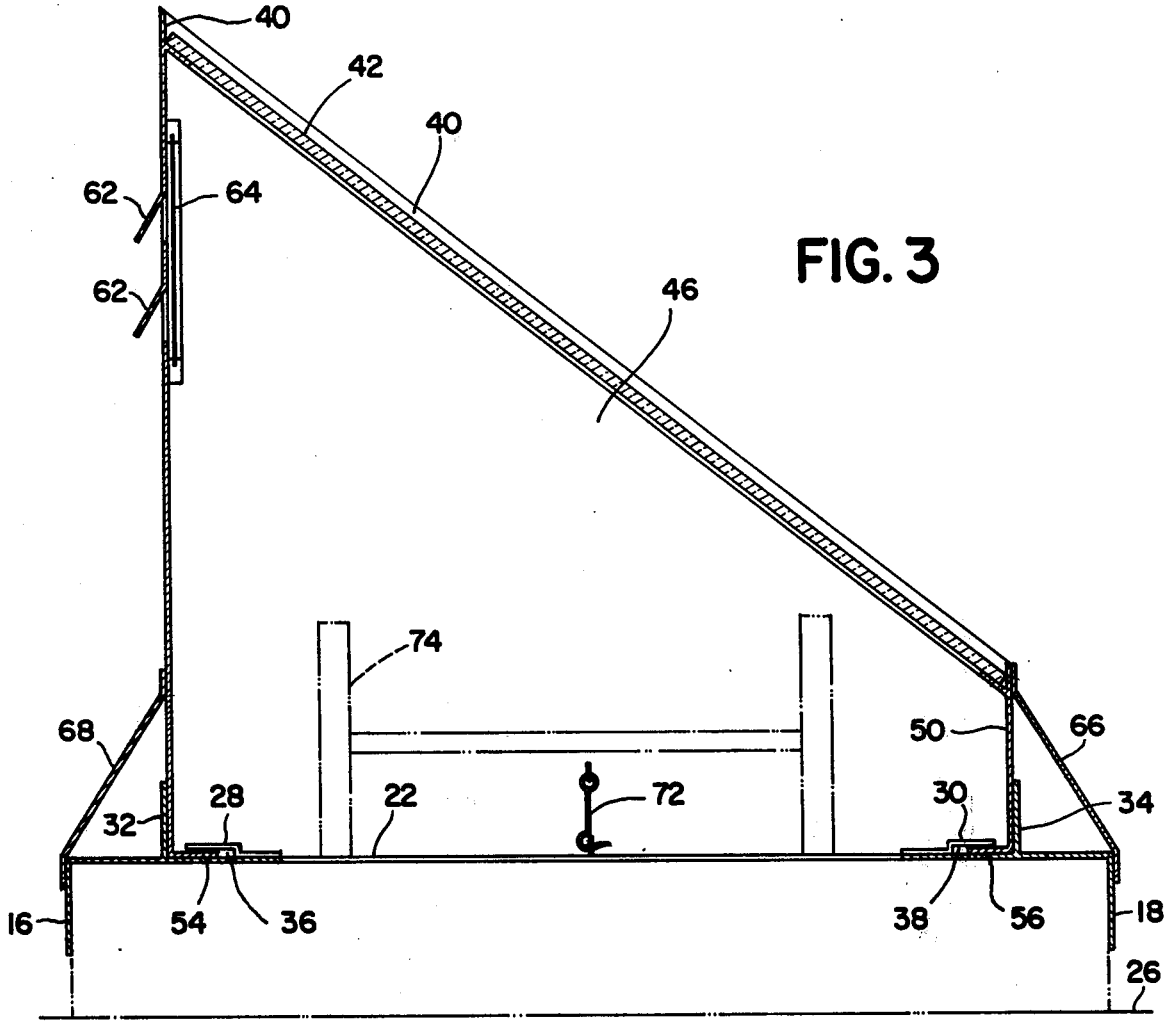
FIG. 3 is a cross-sectional view taken along line 3—3 of FIG. 1, looking in the direction of the arrows.

As best seen in FIGS. 2 and 3, upon the transverse frame members 16, 18 of the curb means 12 are mounted a pair of spaced, transversely extending tracks 28, 30 which are outwardly raised to define respective slide spaces 36, 38 between the tracks 28, 30 and their associated transverse frame members 16, 18. Spaced longitudinally outwardly from the tracks 28, 30 are upwardly extending guides 32, 34 which are provided to facilitate sliding engagement between the curb means 12 and the movable skylight means 14 and to guide the skylight means along its path of movement.

The movable skylight means may be of any desired configuration and is fabricated of suitable dimensions to fully overfit and seat upon the curb means 12 in a weatherproof connection to prevent leakage thereabout. As illustrated, the movable skylight means 14 is fabricated to a generally trapezoidal cross-sectional configuration. However, this configuration is set forth for purposes of illustration and not for limitation. Accordingly, the cross-sectional configuration of the movable skylight means 14 can be of any other desired configuration suitable to slide relative to the curb means 12 and still come within the meaning and intent of this specification. As illustrated, the movable skylight means 14 is provided with suitable retainable flanges 40 to secure therewithin a translucent panel 42 which may be glass, wired glass, sheet plastic or other suitable construction. The movable skylight means comprises generally a pair of spaced, similarly configured end panels 44, 46 which integrally join the back panel 48 in a weatherproof connection. The spaced end panels 44, 46, the interconnecting back panel 48 and the interconnecting, spaced front panel 50 define a skylight opening 52 (FIG. 2) therebetween of size suitable to register over the roof opening 24 defined within the curb means 12 to facilitate the entrance of light and ventilation through the registered openings 52, 24 when the skylight means 14 is fully seated upon the curb means 12 in the manner illustrated in FIG. 1.

Figure 4:
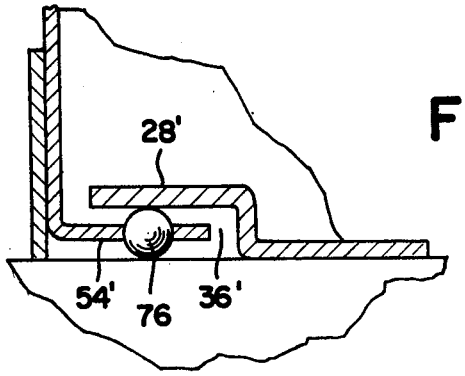
FIG. 4 is an enlarged detail view of a slide embodiment employing rollers.

As best seen in FIG. 3, the back panel 48 extends downwardly and is inwardly bent to define a horizontal slide 54 of adequate strength and of height and length to insert into the slide space 36 defined beneath the track 28 in a sliding engagement as hereinafter more fully set forth. Similarly, the front panel 50 terminates downwardly in an inwardly bent slide 56 of similar suitable height and length dimensions to fit within the slide space 38 which is defined below the front track 30. Accordingly, by applying external, transversely directed forces against either the skylight end panel 44 or the skylight end panel 46, the movable skylight means 14 can be urged transversely relative to the curb means 12 by sliding along the transverse, spaced tracks 28, 30. If desired, as illustrated in FIG. 4, bearing type slide means 76 of known design can be positioned in the space 36' and held by the horizontal slide 54' and interposed between the track 28' and the curb frame construction 16 to permit the movable skylight means 14 to move easier relative to the curb means 12 by substantially reducing the frictional forces that may be encountered.

As best seen in FIGS. 1 and 2, the rear skylight panel 48 (or one of the end panels) can be equipped with a manually openable ventilator 62 of known type which may be opened and closed as desired by a known construction, such as by employing a hinged cover operable by a chain and pulley arrangement (not illustrated). If desired, a screen 64 can be provided over the ventilator opening to prevent the unwanted entrance of insects, debris, etc. therethrough. Depending downwardly from the front and rear skylight panels 50, 48 are suitable hinged, waterproof skirts 66, 68 which are designed to overfit the curb and to facilitate the flow of moisture thereover. Similarly, the end panels 44, 46 can also be equipped with downwardly depending, hinged skirts 70 to transversely overfit the curb frame members 20, 22 for moisture directional purposes. One or more simple, easily openable locks 72, such as a slide bolt or hook and eye lock, of well-known construction are interposed interiorly between the movable skylight means 14 and the curb means 12 to prevent unauthorized entry into the building by discouraging moving the movable skylight means 14 from exteriorly of the building.

In order to use the skylight escape system 10 of the present invention, the slides 54, 56 of the movable skylight means 14 are endwardly positioned adjacent to the respective, cooperating slide spaces 36, 38 and the skylight means 14 is horizontally aligned. With the slides 54, 56 positioned in alignment with the slide spaces 36, 38, the movable skylight means 14 can be urged along the tracks 28, 30 within the guides 32, 34 until the skylight opening 52 registers over the curb opening 24. With the parts in this position, the lock or locks 72 can be made up to secure the parts in the closed position. With the movable skylight means 14 thus positioned upon the curb means 12, light can enter the building through the skylight glass panel 42 and through the aligned openings 52, 24. Similarly, ventilation can enter the building through the ventilator 62 and through the aligned openings 52, 24. It will be noted from FIG. 1 that when the skylight is in the closed and locked position, the various hinged skirts 66, 68, 70 overlie the curb means 12 to facilitate the passage of rainwater and other moisture thereover.

When it is desired to use the skylight escape system 10 as an emergency escape route, a ladder or other occupant elevating means (illustrated in phantom lines) is positioned below the opening 24 to allow the occupant to gain easy access therethrough. The lock or locks 72 are then rapidly opened and transverse forces can then be applied directly upon an end panel 44 or 46 by utilizing hand pressure. Sufficient pressure to overcome the frictional engagement between the slides 54, 56 of the movable skylight means and the tracks 28, 30 and guides 32, 34 of the curb means will cause the movable skylight means 14 to slide transversely relatively to the curb means 12 to thereby expose the curb opening 24 for use as an exit by the building occupants (not illustrated).

After the building occupant or occupants exit through the roof opening 24, they can stand directly upon the roof surface 26 until such time as suitable rescue apparatus is available to remove the occupants from the roof. Optionally, inasmuch as the structure is intended for installation in town houses or row houses as hereinbefore set forth, the occupants can move to safety upon their own volition by walking to the roofs of the next adjacent buildings (not illustrated). It will be noted that the movable skylight means 14 can be traversed along the tracks 28, 30, just sufficiently to expose a sufficient portion of the opening 24 to permit escape of the building occupants. Optionally, if desired, the movable skylight means 14 can be entirely removed from the curb means 12 by pushing the movable skylight means 14 sufficiently until the slides 54, 56 are completely disengaged from the tracks 28, 30.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. In a skylight escape system suitable for use with a fixed curb means comprising transverse frame members and longitudinal frame members defining a roof opening, the combination of a pair of tracks mounted directly upon the frame members of the curb means, the tracks being adapted to slidably receive portions of a movable skylight means therewithin, the tracks including raised portions, the raised portions defining respective slide spaces between the tracks and their associated transverse frame member;

a skylight means including a translucent panel slidably mounted on the tracks, said skylight means comprising a pair of spaced slides, each said slide respectively slidingly engaging one of said tracks and being positioned within one of said slide spaces to permit the skylight means to slide relative to the curb means, whereby the roof opening may be exposed for use as an escape hatch in case of an emergency.

2. Th skylight escape system of claim 1 wherein the tracks further comprise a pair of spaced guides extending in parallel relationship to the tracks, the said guides extending vertically above and being positioned immediately outwardly from a said track to guide the skylight means when the skylight means is moved along the track.

3. The skylight escape system of claim 2 wherein each of the guides is affixed respectively to one of said transverse frame members.

4. The skylight escape system of claim 1 wherein the skylight means further comprise a hinged skirt, said skirt being adapted to depend from below the bottom of the skylight means and to extend over portions of the said curb means, at least part of said skirt being adapted to flex about the hinged portion thereof when the skylight means is moved along the tracks.

5. The skylight escape system of claim 1 wherein the said slides each comprise a horizontal leg, each leg being of suitable height and width to slide within a said slide space.

6. The skylight escape system of claim 5 and antifriction means positioned in each slide space, the antifriction means being positioned in said horizontal slide legs, the antifriction means being movable relative to the tracks when the skylight means is moved.

7. The skylight escape system according to claim 6 wherein the antifriction means are moved within each slide space by its associated slide leg, the antifriction means contacting simultaneously a portion of a track and a portion of a curb transverse frame member.

* * * * *